US011441342B2

(12) United States Patent
Hertel et al.

(10) Patent No.: US 11,441,342 B2
(45) Date of Patent: Sep. 13, 2022

(54) CATCH ARM FOR A DOOR LOCKER UNIT, DOOR LOCKER UNIT WITH CATCH ARM, VEHICLE DOOR WITH DOOR LOCKER UNIT AND VEHICLE WITH VEHICLE SIDE DOORS WITH DOOR LOCKER UNIT

(71) Applicant: INNOMOTIVE SYSTEMS HAINICHEN GMBH, Hainichen (DE)

(72) Inventors: Ulrich Hertel, Chemnitz (DE); Ulrich Krumbiegel, Striegistal (DE)

(73) Assignee: INNOMOTIVE SYSTEMS HAINICHEN GMBH, Hainichen (DE)

( * ) Notice: Subject to any disclaimer, the term of this patent is extended or adjusted under 35 U.S.C. 154(b) by 300 days.

(21) Appl. No.: 16/434,269

(22) Filed: Jun. 7, 2019

(65) Prior Publication Data

US 2019/0376327 A1 Dec. 12, 2019

(30) Foreign Application Priority Data

Jun. 12, 2018 (EP) ..... 18000515

(51) Int. Cl.
*E05C 17/20* (2006.01)
*E05C 17/16* (2006.01)

(52) U.S. Cl.
CPC ..... *E05C 17/203* (2013.01); *E05C 17/16* (2013.01)

(58) Field of Classification Search
CPC ..... E05C 17/203; E05C 17/003; E05C 17/22; E05Y 2900/531; E05Y 2201/21; Y10T 16/61; Y10T 292/305; Y10T 292/288
See application file for complete search history.

(56) References Cited

U.S. PATENT DOCUMENTS

RE18,397 E 3/1932 Eastman
6,113,832 A * 9/2000 Tanaka ..... B29C 45/0005 264/108

(Continued)

FOREIGN PATENT DOCUMENTS

DE 10025185 C2 5/2000
DE 10062274 B4 12/2000

(Continued)

OTHER PUBLICATIONS

Celanese, Celstran® CFR-TPR Composites The Material of Great Inventions™ Continuous Fiber Reinforced Thermoplastic Rod Innovative Reinforcement Technology, 2014, pp. 1-18.

*Primary Examiner* — Justin B Rephann
(74) *Attorney, Agent, or Firm* — Hudak, Shunk & Farine Co. LPA

(57) ABSTRACT

In the case of a catch arm for a door locker unit, in particular of a vehicle door, with at least one elongated body with at least one catch arm head, arranged at its first end, as an end stop element and at least one opening, arranged at its second end, for articulated pivoting with respect to a bearing on which the catch arm is mounted, the catch arm is formed at least partially from at least one fibre-reinforced plastics material, wherein continuous fibres are provided as fibres of the fibre-reinforced plastics material and at least one thermoplastic material is provided as a matrix material of the at least one fibre-reinforced plastics material and the fibres are arranged as an insert in at least one overmoulding material of the catch arm in the form of at least one thermoplastic prepreg, and wherein layers of fibres in the prepreg comprise two or three-dimensional textile reinforcing composite within the thermoplastic matrix material.

21 Claims, 5 Drawing Sheets

(56) References Cited

U.S. PATENT DOCUMENTS

| | | | | |
|---|---|---|---|---|
| 7,552,953 | B2 * | 6/2009 | Schmoll | E05C 17/203 292/267 |
| 9,617,774 | B2 * | 4/2017 | Broadhead | E05C 17/203 |
| 2004/0049882 | A1 * | 3/2004 | Schmoll | E05C 17/203 16/82 |
| 2004/0093691 | A1 * | 5/2004 | Shaw | E05D 11/1071 16/334 |
| 2015/0354259 | A1 * | 12/2015 | Broadhead | E05F 5/06 16/82 |

FOREIGN PATENT DOCUMENTS

| | | | |
|---|---|---|---|
| DE | 10251174 | B4 | 10/2002 |
| DE | 202006020603 | U1 | 7/2006 |
| DE | 202011051957 | U1 | 11/2011 |
| GB | 2229668 | A | 10/1990 |
| GB | 2355489 | A | 4/2001 |
| JP | 6143541 | A | 3/1986 |
| WO | 9935358 | A1 | 7/1999 |
| WO | 9952703 | A1 | 10/1999 |
| WO | 2008063398 | A2 | 5/2008 |
| WO | 2015188259 | A1 | 12/2015 |

* cited by examiner

CATCH ARM FOR A DOOR LOCKER UNIT, DOOR LOCKER UNIT WITH CATCH ARM, VEHICLE DOOR WITH DOOR LOCKER UNIT AND VEHICLE WITH VEHICLE SIDE DOORS WITH DOOR LOCKER UNIT

FIELD OF THE INVENTION

The invention relates to a catch arm for a door locker unit, in particular of a vehicle door, with at least one elongated body with at least one head, arranged at its first end, as an end stop element and at least one opening, arranged at its second end, for articulated pivoting with respect to a bearing on which the catch arm is mounted, to a door locker unit with at least one such catch arm, at least one latching element, which is supported on the catch arm, and at least one housing, the latching element, in particular a latching link or a pressure element, being movably mounted in or on the housing, and the catch arm extending through at least part of the housing and being mounted in an articulated manner, to a vehicle door with at least one such door locker unit and to a vehicle with at least two correspondingly designed vehicle side doors.

BACKGROUND OF THE INVENTION

Door locker units with at least one catch arm for use with a vehicle side door are known in a wide variety of configurational variants in the prior art. A catch arm of such a door locker unit serves in combination with a latching link or a pressure element, which is supported on the catch arm, for making various latching positions of the door, in particular vehicle door, possible. For this purpose, the catch arm, which has at least one elongated body, has at its one end a projecting head as an end stop element for making an end stop possible when opening the door, in particular vehicle door. Furthermore, the catch arm also assists the closing of the door, in particular vehicle door, while this can be made possible in particular by a special shaping of the catch arm. The catch arm formed in an elongated manner, that is to say with at least one elongated body, may in this case be formed as slightly curved in one plane. In order to make at least temporary arresting of the door possible in different positions during the opening and closing of the door, in particular vehicle door, the latching element or elements, which may be formed in particular in the form of a latching link or a pressure element, is or are provided. During the movement from a respective latching position along the catch arm, compressive and frictional forces are applied in particular to two mutually opposite sides of the catch arm. However, a catch arm undergoes principal loading by tensile forces in the direction of its longitudinal extent, which occur in particular when the end stop is reached. These forces are greatest especially when there is excessive pushing against an opened door, falling open of a door, such as a vehicle side door, when a vehicle is in a tilted position, for example when it is left on a longitudinally and/or transversely inclined carriageway, or else when there are gusts of wind acting on an opened door, in particular vehicle door. Up to a predeterminable limiting load, catch arms should withstand such stresses undamaged, while damage that occurs to the catch arm above such a predeterminable limiting load can be allowed if its basic functionality is maintained. On account of its positioning between in particular a vehicle side door and a vehicle body of a vehicle and the time at which it is fitted, the catch arm of a door locker unit is exposed to both high and low temperatures, moisture, dirt and corrosive media throughout its entire lifetime.

Accordingly, it is also known to form a catch arm either completely from steel or from an unreinforced thermoplastic material with a steel insert. The use of steel makes it possible to transmit high forces, but leads to a relatively great weight. When a catch arm from the prior art is formed by a steel insert that is enclosed by an unreinforced thermoplastic material, there is also the problem that the thermoplastic material has a different coefficient of thermal expansion than steel, which tends to promote crack formation in the catch arm. It is also required to pretreat the surfaces of the steel insert in order to achieve good bonding of the thermoplastic material on the surface of the steel insert. Door locker units with correspondingly designed catch arms are known for example from DE 20 2006 020 603 U1, DE 20 2011 051 957 U1, DE 100 25 185 C2, DE 102 51 174 B4, and DE 100 62 274 B4. In the case of DE 20 2011 051 957 U1, DE 20 2006 020 603 U1 and DE 100 25 185 C2 as well as DE 102 51 174 B4, the respective catch arms have plastic-enclosed metal inserts or metal cores. According to DE 100 62 274 B4, the catch arm is designed as a flat blank of metallic material which is produced by stamping or forging. Two flat material blanks are in this case placed one on top of the other and connected to one another in the region of a bearing eye and an end stop in such a way that that they act like one part. Furthermore, this prior art document also discloses at least forming the surface of the catch arm from a plastic.

On account of the relatively great weight of a metal or steel insert which is enclosed with plastic to be formed as a catch arm, and on account of the additional effort involved in pretreating the surfaces of the metal or steel insert to make good bonding of the latter on the enclosing plastics material possible, it would be desirable to provide a different solution here, which on the one hand has a lower weight and on the other hand makes it possible for less effort to be involved in production, in particular by eliminating a pretreatment step.

SUMMARY OF THE INVENTION

The present invention is therefore based on the object of providing a catch arm for a door locker unit, in particular of a vehicle door, with at least one elongated body with at least one head, arranged at its first end, as an end stop element and at least one opening, arranged at its second end, for articulated pivoting with respect to a bearing, a door locker unit with such a catch arm, a vehicle door with at least one such door locker unit and a vehicle with at least one such vehicle door, with which the aforementioned problems of the known catch arms do not occur, but rather a catch arm with a comparatively low weight is provided, the production of which is possible in particular without laborious prior measures of pretreating a stabilizing insert or inner element, in particular such an insert or element that absorbs tensile forces.

The object is achieved for a catch arm for a door locker unit, in particular a vehicle door, comprising at least one enlongated body with at least one catch arm head, arranged at its first end, as an end stop element and at least one opening, arranged at its second end, for articulated pivoting with respect to a bearing on which the catch arm is mounted, the catch arm being formed at least partially from at least one fibre-reinforced plastics material, wherein continuous fibres are provided as fibres of the fibre-reinforced plastics material and at least one thermoplastic material is provided as a matrix material of the at least one fibre-reinforced plastics material and the fibres are arranged as an insert in at least one overmoulding material of the catch arm in the form of at least one thermoplastic prepreg, and wherein layers of fibres in the prepreg comprise two or three-dimensional textile reinforcing structures within the thermoplastic matrix material. For a door locker unit with at least one catch arm, at least one latching element, which is supported on the catch arm, at least one housing, the latching element, in particular a latching link or a pressure element, being movably mounted in or on the housing, and the catch arm extending through at least part of the housing and being mounted in an articulated manner, the object is achieved by the at least one catch arm being such a catch arm. For a vehicle door, the object is achieved by at least one such door locker unit with at least one such catch arm being provided. For a vehicle with a vehicle body and at least two vehicle side doors, the object is achieved by the latter being connectable or connected to the vehicle body by way of in each case at least one such door locker unit with at least one such catch arm. Developments of the invention are defined in the dependent claims.

As a result, a catch arm for a door locker unit and such a door locker unit are created, the catch arm consisting at least partially of at least one fibre-reinforced plastics material. The catch arm may consequently contain not just one fibre-reinforced plastics material but also a number of different such materials. This may prove to be advantageous application-specifically. As a result of using fibre-reinforced plastics material, the catch arm has a much lower weight than a catch arm of the prior art produced from steel or provided with a steel insert. As a result of providing a fibre-reinforced plastics material, it can be adapted particularly well to a tensile force acting on the catch arm in order to be able to offer adequate resistance to tensile forces acting on it, in particular in the longitudinal direction of the catch arm. The catch arm may in this case consist completely of a fibre-reinforced plastics material or have in its core region instead of a steel insert from the prior art at least one fibre-reinforced plastics material which is at least partially enclosed on the outside with a further plastics material. Specifically when providing a core of the catch arm of a fibre-reinforced plastics material which is at least partially enclosed on the outside with a further plastics material, a much greater material compatibility is possible, and consequently a much easier, in particular material-bonding, connection of the fibre-reinforced plastics material and the enclosing plastics material of the catch arm is possible in comparison with the combination of steel and a plastics material, which also leads to an increase in the quality of the catch arms produced in this way as compared with the catch arms of the prior art. Further, also the treatment and handling of the plastics materials is easier since they have comparable thermal extensions.

From the catch arm first end to the catch arm second end fibre deposition within the insert may be provided appropriate for the load paths. Advantageously, the fibres of the fibre-reinforced plastics material are oriented in the direction of the principal loading of the catch arm, consequently in particular in the longitudinal direction of the latter. Since particularly high tensile forces, consequently the principal load, can occur in particular in the longitudinal direction of the catch arm, the use of fibres of the fibre-reinforced plastics material that are mainly oriented in the longitudinal direction of the catch arm is particularly suitable. Long fibres and/or continuous fibres are preferably provided as fibres of the fibre-reinforced plastics material. Long fibres can be processed in the moulding process, while continuous fibres can be brought into the form of an insert and subsequently overmoulded with plastics material. It is also possible to provide the fibres of the fibre-reinforced plastics material in the form of at least one thermoplastic prepreg. It is possible here to form the catch arm completely from such a re-formed thermoplastic prepreg, in particular in the form of a so-called organo sheet. The fibres of the respective fibre-reinforced plastics material can consequently be overmoulded with thermoplastic material in the desired arrangement. Here, the desired shaping can already be set by suitable choice of the injection mould or, in the case of thermoplastic prepregs that are not in the final form, their re-forming into the desired shaping for use in or as a catch arm can be performed. Both injection-moulding processes and re-forming processes make a stability of the process possible during the production of the catch arms and likewise make short cycle times possible in particular in comparison with the pretreatments of the steel inserts required in the case of the known catch arms, to make possible a stable connection to the plastics material used for the overmoulding. The possibility of injection-moulding thermoplastic material or re-forming not only means that production processes suitable for mass production are made possible, but also that the production costs of the catch arms can be reduced, also as a result of the possibility of using standard plastics materials instead of specially adapted plastics materials, which may be required for example for a particularly good connection to steel inserts in the case of catch arms of the prior art. Further, overmoulding with thermoplastic material is very advantageous for the manufacturing of sliding surfaces which are the underside and the upper side surfaces of the elongated or longitudinal catch arm body between the catch arm head at the first end of the catch arm and its second end having an opening where the catch arm is pivotally mounted on a bearing element. A latching cam of a latching link can slide along the elongated catch arm body sliding surfaces and can engage in latching grooves in a latching manner in order to arrest a vehicle door in various latching positions. Instead of a thermoplastic material also a thermosetting material can be provided which thermosetting material, however, is much more expensive and, thus, not economical. Any fibres are preferably not provided at the sliding surfaces since fibres could injure the sliding surfaces.

The fibres of the fibre-reinforced plastics material may be in particular glass fibres. Instead of glass fibres or in addition to them, it is likewise possible to use other fibres, depending on the application, such as for example carbon fibres, aramid fibres, etc. Instead of a standard plastic, it is likewise possible to use high-performance plastics or thermosets as a matrix material in combination with the fibres to form the fibre-reinforced plastics material. It is likewise possible to form the catch arm by pressing glass mat reinforced thermoplastics (GMT). Consequently, not only can individual fibres be embedded in the desired form in the plastics material but also fibre mat reinforced plastics can be used to form at least parts of a catch arm of a door locker unit for, in particular, a vehicle door of a vehicle. The fibres can consequently be overmoulded, for example as long fibres, with the desired plastics material directly in the injection-moulding process, and consequently be embedded completely or at least partially in this material, be pressed in mat form with at least one thermoplastic material or be processed as quasi-unidirectional textiles or sheet-like formations, such as for example knitted or woven fabrics, nonwovens, etc. or in the form of rovings in a composite, for example a multilayer composite, with thermoplastic material into prepregs. The two or three-dimensional textile reinforcing structures may be layers of fibres in the prepreg. Layers of fibres in the prepreg may comprise for example spread-out rovings or such sheet-like formations, such as woven or knitted fabrics or nonwovens as multi-dimensional textile structures, i.e. two or three-dimensional textile structures. Not only in the injection-moulding process but also when pressing and when processing into a prepreg, fibre deposition appropriate for the load paths and prefabrication of near-net-shape textile sheet-like formations is possible, that is to say sheet-like formations that come close to the desired final contour of the catch arm. Depending on the respective portion or the respective location in the catch arm body and head, the load paths during the loading of the catch arm may be different. Depending on this, the fibres may also have a different orientation, correspondingly adapted to the load path, along the longitudinal extent of the catch arm. The fibre orientation within the respective load arm is also likewise dependent on its outer shaping, which for its part is dependent on the respective vehicle in which the catch arm or the door locker unit with at least one catch arm is used. Correspondingly, the fibre orientation may also be optimally adapted thereto. Thus, the catch arm can bear high loads and is fail-safe caused by its high strength.

In the region of the catch arm head, an additional fibre orientation, in addition to that provided in the region of the elongated catch arm body, or at least a different fibre orientation than in the region of the elongated catch arm body is advantageously provided. Since a load introduction and particular loading by tensile forces occurs specifically in the region of the catch arm head, it proves to be advantageous to reinforce specifically this region, or the region of the transition to the catch arm body, by differently oriented fibres and/or fibres that are at least at an angle to the fibres oriented in the longitudinal direction of the catch arm body. The fibres may for example be arranged in a number of layers one on top of the other and be differently oriented, while this may also be provided just in some portions or locally along the longitudinal extent of the catch arm in the region of the catch arm head, at the location of the transition to the catch arm body and along the latter.

The catch arm head may in particular be or have been formed from at least one fibre-composite insert by twisting the latter by a twisting angle, in particular a twisting angle of 90°, and/or fanning out and connecting a fibre-composite insert to further layers of material. Since the catch arm head then is directly integrally shaped interference sources can be reduced. For forming the catch arm head by twisting the at least one fibre-composite insert, by in particular a twisting angle of 90°, a very stable catch arm head, and accordingly also catch arm, can be formed in an easy way. By fanning out the fibre-composite insert, which otherwise extends linearly to form the catch arm body, the catch arm head can be formed. In order to create a large volume of the catch arm head, further fibre-composite layers or layers of material may be arranged on and/or under the fibre-composite insert fanned out in such a way. By providing further fibre-composite layers or layers of material the catch arm head may, in addition, also be reinforced. It is likewise also possible to form the catch arm head without twisting from at least one fibre-composite insert, by corresponding shaping or cutting to size of the latter. In addition or as an alternative to this, the catch arm head may also be formed by at least one metal element, in particular at least one plate-shaped and/or pin-shaped metal element. The in particular plate-shaped and/or pin-shaped metal element may also be or have been connected to at least one organo sheet, the organo sheet forming the catch arm body and the metal element forming the catch arm head. For example, it is possible to wrap at least one organo sheet around the metal element, the metal element extending substantially perpendicularly in relation to the organo sheet and being arranged within the wrapping loop of the organo sheet. The organo sheet or a fibre band may advantageously be provided as at least one closed running-around band. A steel element may be provided for example as the metal element, in particular plate-shaped and/or pin-shaped metal element. Instead of such a so-called organo sheet, the fibres may also be arranged in the form of a textile, that is to say a knitted or woven fabric or nonwoven, and in particular be connected to the metal element by wrapping. Instead of a metal element, an element of another stable material, such as for example a plastics element, may also be used.

An organo sheet is understood in the present case as meaning a fibre-composite material which consists of a woven or nonwoven fibre fabric as a semi-finished fibre-matrix product, which is embedded in a matrix of thermoplastic material. By providing a matrix of thermoplastic material, the semifinished fibre-matrix products can be reformed when warm, which leads to shorter process times in comparison with conventional thermoset fibre-composite materials. Glass fibres, aramid fibres, carbon fibres and other fibres come into consideration as fibre materials. The mechanical properties of an organo sheet, such as stiffness, strength and thermal expansion, are determined in part by the arrangement of the fibres, in particular in the form of a woven and/or nonwoven fabric, in which the fibres are arranged at an angle to one another, in particular run at right angles to one another. As a result, the mechanical properties can be predetermined better than in the case for example of a steel insert in a catch arm, and can be optimally made to match the respective application. The tensile and compressive behaviour of organo sheets, and similarly their mechanical and thermal properties, are non-isotropic, that is to say are direction-independent with respect to the spatial structure.

The opening at the second end of the catch arm for receiving a bearing journal or bearing pin for the pivoting of the catch arm with respect to a bearing in the vehicle body may be provided with at least one sleeve with or of at least one stable material, in particular at least one metal sleeve, and/or at least one bush, for example a bush wound from fibres, for reinforcement. Furthermore, the opening may be or have been produced by drilling or by means of a warm mandrel. For reinforcement, the opening may also be stitched around and/or provided with fibres around the opening. For example, the fibres may be laid around the opening in such a way as to wrap around it or avoid it, that is to say lead away or be directed away from it. Specifically in the region of the opening at the second end of the catch arm, which serves for the articulated, pivotable mounting of the catch arm on a bearing bush or a bearing pin that is arranged in the vehicle body, adequate stability should be provided. Therefore, this can be provided by the additional provision of a sleeve or bush, which is inserted into the opening and accordingly leads to a reinforced opening, it being possible that the sleeve or bush is not only produced from metal or some other stable material, but also from fibres or fibre-reinforced plastic. A stitching surround for the opening to reinforce it may likewise be provided by fibre material that creates a correspondingly great stiffness or strength and dimensional stability for the opening. Laying fibres around the opening leads to a correspondingly reinforcing effect. When such stiffening or reinforcement of whatever kind is provided, propagation or creep of a crack, such as can occur when there is an unreinforced hole or an unreinforced opening, can be prevented. In particular, the fibres may be laid around the opening appropriately for the load paths, thereby creating a reinforcement. By introducing the bore or opening by means of a warm mandrel, interruptions of the fibres in the region of the opening can be prevented. This also applies when stitching or otherwise sewing or winding fibres around the opening or bore. Furthermore, it is also possible to provide, running around, at least one additional or single reinforcing layer in the region of the second end of the catch arm, which is provided with the opening, perpendicularly in relation to an insert produced from fibre-composite material. Such a reinforcing layer may be arranged not only running around in the region of the opening at the second end of the catch arm, but also along the entire longitudinal extent of the catch arm up to its catch arm head and around the latter or in the entire region of the latter. The at least one reinforcing layer may be formed for example in the form of a closed band, ring, wrap or bush, possibly in combination with a metal part or other reinforcing part in the catch arm head. In particular, it is possible to produce a running-around ring of fibres which is reversed in the region of both ends of the catch arm, for example by way of a pin-shaped or sleeve-like element arranged there. For example, the running-around ring of fibres may be reversed at the catch arm head by way of a pin-shaped element and at the opposite second end of the catch arm by way of an element arranged there in the form of a sleeve or bush that encloses the opening for receiving a bearing journal. Furthermore, the region at the second end of the catch arm that is provided with the through-opening or opening may be formed in a thickened manner, by providing a multi-axially reinforced fibre-composite material. A number of the aforementioned possibilities for reinforcing the catch arm, and in particular the opening at the second end thereof, may be provided in combination with one another.

In principle, it is possible also to form the catch arm completely from organo sheet, consequently at least partially fibre-reinforced plastics material. As a result, the method step of overmoulding an insert of the catch arm produced from fibre-reinforced plastics material can be avoided, since the catch arm produced from such an organo sheet can be cut to size and/or re-formed into the desired shape. This can have in a predeterminable manner the fibre orientation that is optimized application-specifically.

Using fibre-reinforced plastics material in a catch arm of a door locker unit leads to a reduction in the mass of the catch arm of up to 50% in comparison with the use of an insert of steel in the prior art. On account of the possibility of connecting similar plastics to one another in a material-bonding manner when overmoulding a core element of the catch arm produced from fibre-reinforced plastics material with a second plastics material, there is no longer any failure of the catch arm due to the differentness of the materials used, as can happen with the known catch arms using steel and plastic. Furthermore, the processing of the materials used for producing the catch arm is also made 20 much easier, since only plastics materials need to be connected to one another, or only one fibre-reinforced plastics material is used in the first place. Furthermore, crack formations caused by different expansions of steel and plastic when there are changes in temperature, such as can often occur with catch arms of the prior art, are no longer to be feared. Rather, such damage to the catch arm due to temperature fluctuations can be reliably avoided by the use of fibre-reinforced plastics material, in particular in combination with at least one further plastics material. As a result, an increase in quality is also achieved, while neither adhesion promoters nor surface treatments are required for connecting fibre-reinforced plastics material and at least one further plastics material to form the catch arm. Moreover, it is also possible to dispense with high-energy production and processing of steel as an insert in a catch arm of the prior art if the fibre-reinforced plastics material is provided. Serving as the matrix material for the fibre-reinforced plastics material is at least one plastics material, in particular at least one thermoplastic material, in which fibres are embedded or integrated or are/have been overmoulded by the material. Three-dimensional composites or structures, such as woven or knitted fabrics or nonwovens as textile reinforcing structures, are used which are preferably prefabricated and made of organo sheets, and which provide for a continuous force absorption. Thus, the textile composite or structure design is appropriate for the load paths. The catch arm can bear very high tensile forces and, in addition, also lateral forces and side loads which is caused by this multi-axial textile reinforcing structure or composite. By use of textile manufacturing processes three-dimensional reinforcing structures or composites can be provided which make possible a direct integral shaping or incorporation of the end stop which is built by the catch arm head. For an optimal load application it is necessary to extend the reinforcing structure or composite along the complete catch arm extension and to not disturb the distribution of forces within the fibres. Further, by use of a closed running-around band of fibres no additional shaping is necessary since only the band's ends are connected to a closed ring. Especially a pin-shaped metal element may be inserted into the closed ring as the catch arm head. However, no metal insert is used for the catch arm. Further, integrally shaping of the catch arm head as a fibre composite might be provided by twisting or providing additional layers. Thus, the expenditure in manufacturing and the manufacturing costs are reduced as compared to the prior art solutions. Also, temperature-related strain differences caused by the different materials of the prior art solutions can be prevented.

BRIEF DESCRIPTION OF THE DRAWINGS

For a more detailed explanation of the invention, exemplary embodiments of it are described more specifically below on the basis of the drawings, in which.

DETAILED DESCRIPTION OF THE INVENTION

Figure 10A:
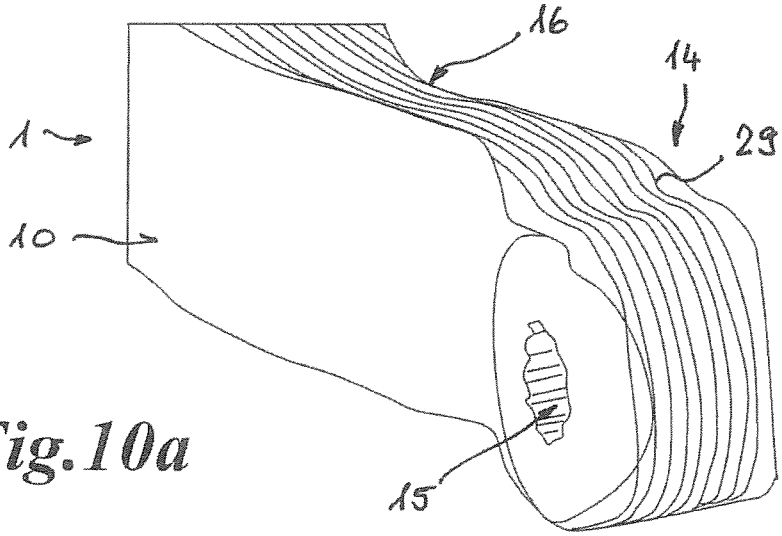
FIG. 10*a* shows a perspective view of a detail of a further embodiment of a catch arm body according to the invention, a running-around reinforcement being provided for an opening provided at the end of the catch arm body by fibres running around there in the longitudinal direction of the catch arm body.
Figure 10B:
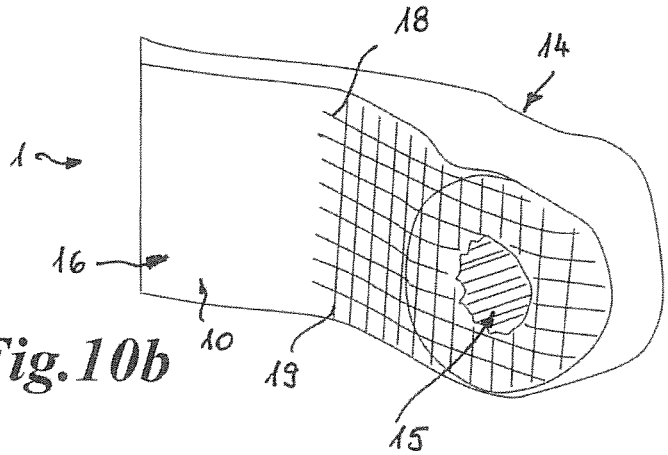
FIG. 10*b* shows a perspective view of a detail of one end of a catch arm body according to the invention of a door locker unit according to the invention, an opening that is provided there being reinforced by multi-directional arrangement of fibres or layers of fibres for reinforcement while at the same time thickening this end of the catch arm body.
Figure 10C:
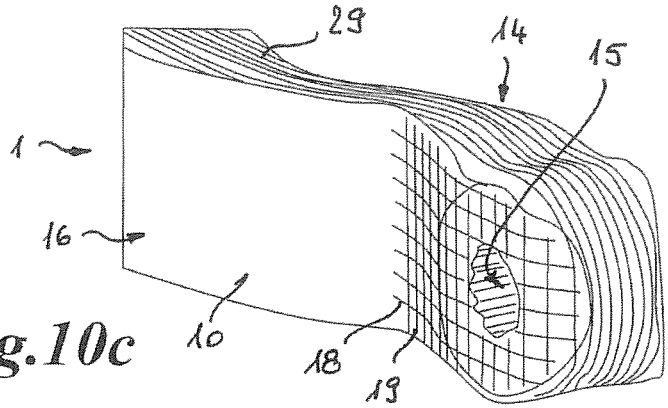
FIG. 10*c* shows a perspective view of a detail of one end of a catch arm body according to the invention of a door locker unit according to the invention in the design as a combination of the configurational variants that are shown in FIGS. 10*a* and 10*b*, with the provision of a running-around reinforcement by fibres and multi-directional arrangement of further layers of fibres while thickening the end of the catch arm body.
Figure 11:
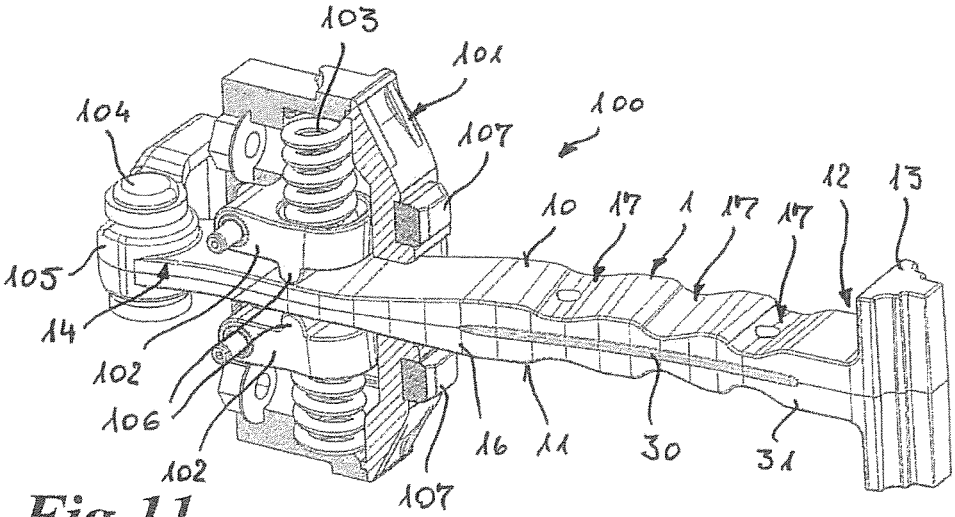
FIG. 11 shows a perspective view of a door locker unit with a catch arm according to the invention with an insert of fibre-reinforced plastics material.
Figure 12:
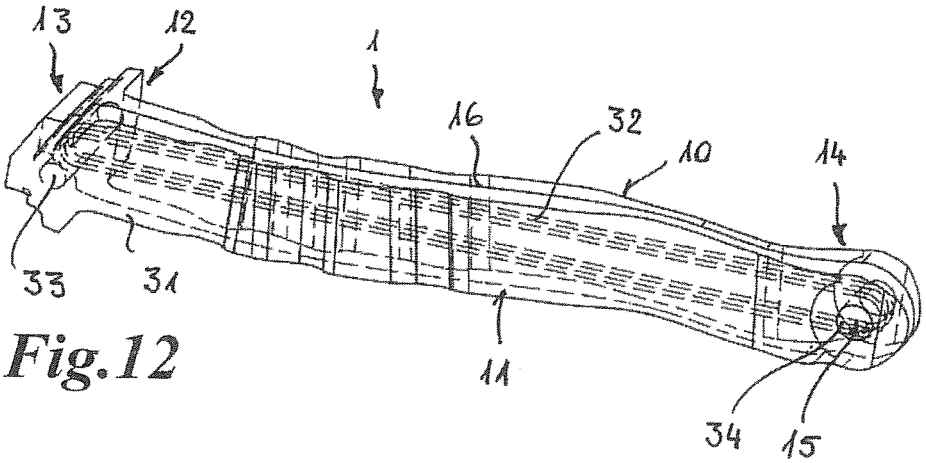
FIG. 12 shows a perspective view of a catch arm according to the invention with a running-around ring of fibres as an inner reinforcing layer.
Figure 13:
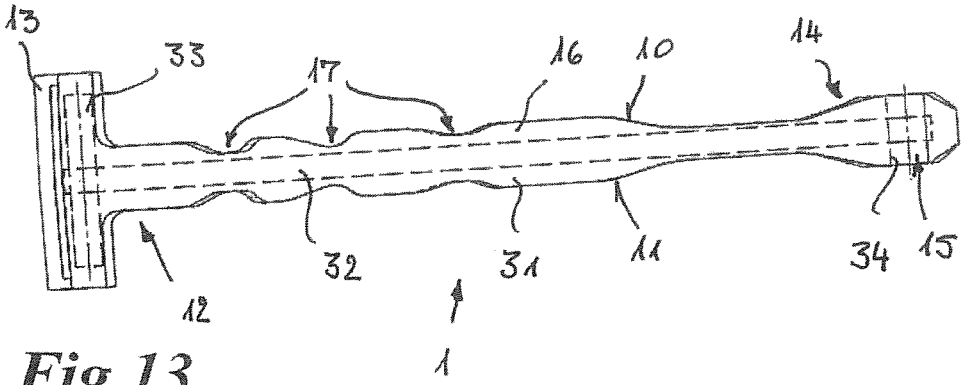
FIG. 13 shows a plan view of the catch arm according to FIG. 12.

FIG. 11 shows by way of example a door locker unit 100, comprising a catch arm 1, which is accommodated in a housing 101 of the door locker unit 100 or extends transversely through the housing. Arranged inside the housing 101 are two latching links 102, which are supported on two mutually opposite sides, to be specific an upper side 10 and an underside 11, of the catch arm 1. The latching links 102 are supported on the upper side 10 and the underside 11 of the catch arm 1 while applying a compressive force, which is applied by a spring 103 of the latching links 102. Instead of the latching links, at least one pressure element may also be provided for exerting the compressive force. The door locker unit 100 shown in FIG. 11 merely serves the purpose of illustrating in principle the components of such a door locker unit 100 and the fastening thereof on a vehicle body on the one hand and a vehicle door on the other hand. The housing 101 of the door locker unit 100 is fastened on a vehicle door (cannot be seen in FIG. 11). The catch arm 1 has at its first end 12 a widely projecting, sturdy catch arm head 13 as an end stop element for the vehicle door and, at its opposite second end 14, an opening or through-opening that cannot be seen in FIG. 11 but can in FIGS. 6 to 10*c*, through which there extends a hinge pin 104 in order to make articulated pivoting possible with respect to a bearing 105, which is connected to a vehicle body (not shown in FIG. 11).

Between the catch arm head 13 at the first end 12 of the catch arm 1 and the second end 14 with the opening, the catch arm extends with an elongated or longitudinal catch arm body 16. In the example shown in FIG. 11, this has three latching grooves 17 on the upper side 10 and the underside 11, into which a latching cam 106 of the respective latching link 102 can engage in a latching manner in order to arrest the vehicle door in various latching positions. The latching links 102, which are prestressed with respect to the catch arm 1 inside the housing 101 by the compression spring 103, can latch into the latching grooves 17. If the vehicle door connected to the housing 101 of the door locker unit 100 is pivoted with respect to the vehicle body connected to the bearing 105, at the same time the housing 101 connected to the vehicle door is displaced with respect to the catch arm 1 until the maximum opening angle of the vehicle door with respect to the vehicle body is reached. In this position, the catch arm head 13 lies against the housing 101 on the outside, and consequently prevents further displacement of the housing 101 with respect to the catch arm 1. For damping the end stop of the housing 101 on the catch arm head 13, the housing 101 is provided on the outside with two damping bodies 107, against which the catch arm head 13 strikes in a damped manner.

The catch arm 1 is formed from or comprises fibre-reinforced plastics material. In particular, an insert 30 of fibre-reinforced plastics material may be surrounded by further plastics material 31 or be embedded in it, as indicated in FIG. 11.

Figure 1A:
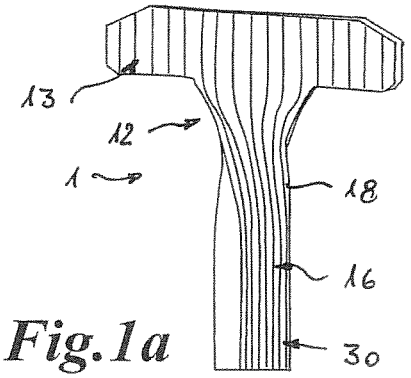
FIG. 1*a* shows a perspective view of a detail of a first embodiment of a catch arm according to the invention for a door locker unit of a vehicle door of a vehicle.

FIG. 1*a* shows a configurational variant of the catch arm 1 in the region of the catch arm head 13, which has fibres 18 that are embedded in thermoplastic material and extend unidirectionally in the direction of the longitudinal extent of the catch arm 1. The catch arm 1 is formed by an insert 30 of fibre-reinforced plastics material formed with such unidirectionally aligned fibres. Here, the catch arm head 13 has been offset with respect to the catch arm body 16 by twisting by an angle of for example approximately 90°. By local heating of the insert produced from a fibre-reinforced plastics material to form the catch arm 1, the latter can be brought into the desired shaping, that is to say in particular the portion forming the catch arm head 13 can be twisted with respect to the catch arm body 16, in an energy-saving and material-sparing manner.

Figure 1B:
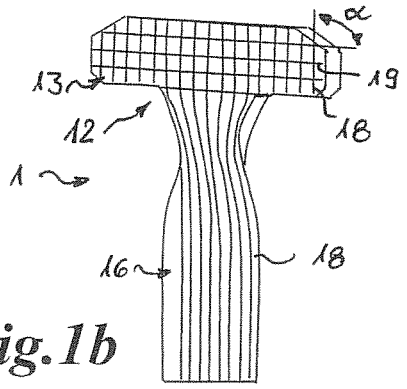
FIG. 1*b* shows a perspective view of a detail of a second embodiment of a catch arm according to the invention for a door locker unit, in which a unidirectional arrangement of fibres combined with a multi-directional arrangement of the fibres in the region of the catch arm head is provided.

In a modification of the configurational variant of the catch arm shown in FIG. 1*a*, the catch arm shown in FIG. 1*b* has in the region of the catch arm head 13 not only the fibres 18 provided for reinforcement in the longitudinal direction of the catch arm 1, but also fibres 19 extending transversely in relation to them, so that the fibres 18, 19 extend multidirectionally in the region of the catch arm head 13. The angle α, at which the fibres 18 and 19 are arranged in relation to one another, may be for example approximately 90°, as shown in FIG. 1*b*. Similarly, any other angular arrangements of the multi-directional fibres in relation to one another are also possible. In particular, it is likewise possible to provide a number of layers of fibres with fibre directions arranged differently in relation to one another.

Figure 1C:
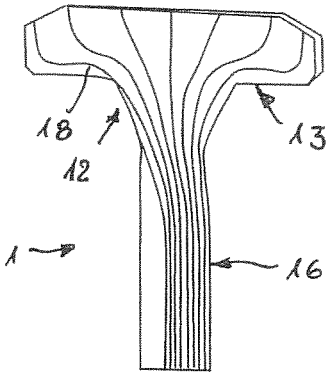
FIG. 1*c* shows a perspective view of a detail of a third embodiment of a catch arm according to the invention for a door locker unit, a deposition of fibres appropriate for the load paths being provided in the catch arm head.
Figure 4:
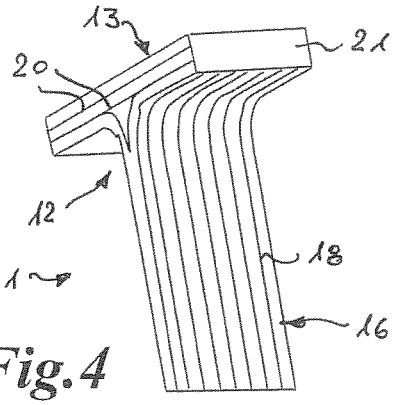
FIG. 4 shows a perspective view of a detail of a sixth embodiment of a catch arm according to the invention with a fanning out of the layers of fibres from a band of fibres in combination with further layers of material to form a catch arm head.

In the case of the configurational variant shown in FIG. 1*c*, the fibres 18 are fanned out in the region of the catch arm head 13 in order to be arranged appropriately for the load paths. This means that, in adaptation to the forces acting on the catch arm head 13, a respective reinforcement is performed by the fibres 18 fanned out there. As shown in FIG. 4, on the one hand a number of fanned-out layers of fibres 18 and in addition to these still further covering layers 21 with fibres 20 may be applied one on top of the other in the region of the catch arm head 13. These further covering layers 21 may also be formed without further fibres 20, for example merely as layers of plastics material.

Figure 2:
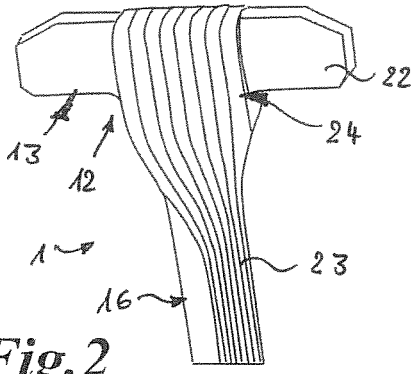
FIG. 2 shows a perspective view of a detail of a fourth embodiment of a catch arm according to the invention for a door locker unit, comprising a metal element around which an organo sheet is wrapped, with unidirectional reinforcement in the region of the catch arm head.

As shown in FIG. 2, the catch arm head 13 may also be formed by providing at least one metal element 22, it being possible for the metal element 22 to be formed in a strip-shaped manner and/or for example in a T-shaped or else pin-shaped manner. The metal element 22 extends transversely in relation to a band of fibres 23 and is wrapped around by the latter. The angle between the portion of the metal element 22 that is projecting with respect to the band of fibres 23 and the band of fibres 23 may be for example approximately 90°. The metal element 22 is accommodated within a wrapping loop 24 of the band of fibres. The band of fibres 23 may take the form of a band of fibre-reinforced plastic, for example a so-called organo sheet. In the case of the configurational variant shown in FIG. 2, the band of fibres 23 has been twisted in the region of the wrapping loop 24 with respect to the latter and the orientation of the metal element 22 by an angle of approximately 90°. This helps to keep the metal element 22 in the wrapping loop 24 of the band of fibres 23.

If such twisting of the head and body of the catch arm with respect to one another is not carried out, the housing 101 of the door locker unit 100 may be designed correspondingly in order to prevent undesired slipping of the catch arm head 13 through the housing in the region of the latching links 102. Even when dispensing with twisting of the catch arm head with respect to the catch arm body, the respective orientation and arrangement of the fibres 18, 19 in the catch arm head 13 and catch arm body 16 may also be designed in a way corresponding to the configurational variants that are shown in FIGS. 1*a* to 2. In the case of all the configurational variants of the catch arm 1, the fibres of the fibre-reinforced plastics material, which is provided as an insert of the catch arm or of which the catch arm consists completely, can reinforce the catch arm, especially also at interfaces with other components or locations of load introduction, in a correspondingly adapted manner by arranging the fibres or layers of fibres of the fibre-reinforced plastics material in such a way as to be oriented for the load paths. Such an adaptation may take place over the entire longitudinal extent of the catch arm, consequently not only at the catch arm head 13 but also along the entire catch arm body 16, and in particular also at the transition from the catch arm head 13 to the catch arm body 16. It is likewise possible to provide fibre reinforcements only at the locations along the extent of the catch arm 1 at which particular loads may occur on account of the coming together of different materials. Accordingly, the fibres 18, 19, 20 of the fibre-reinforced plastics material that is arranged along the catch arm 1 or forms it may be arranged not only on the surface of the catch arm 1 but also within its body and head. If the fibres are arranged on the surface of the catch arm, for example in the form of glass fibres, aramid fibres, carbon fibres, etc., it may be advisable for avoiding wear at the respective latching link 102 or the latching cams 106 thereof to form them from a sufficiently resistant material.

Figure 3:
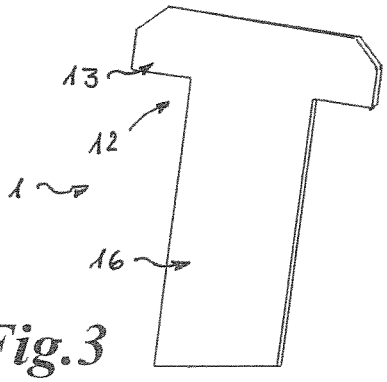
FIG. 3 shows a perspective view of a detail of a fifth embodiment of a catch arm according to the invention for a door locker unit, the catch arm head being formed without any twisting, that is to say merely as a flat, planar fibre-composite mat.

The catch arm 1 shown in FIG. 3 does not have any twisting of the catch arm head 13 in relation to the catch arm body 16, and is therefore formed as uniformly flat. The catch arm 1 may be formed completely from organo sheet, which is correspondingly cut to size and re-formed and which has a fibre alignment of the fibres in the fibre-reinforced plastics material that is correspondingly adapted to the respective application.

Figure 5A:
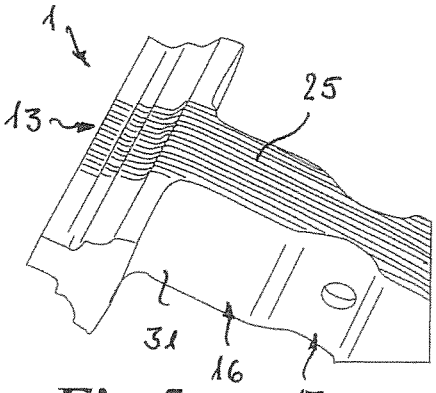
FIG. 5*a* shows a perspective view of a detail of a seventh embodiment of a catch arm according to the invention with a running-around additional unidirectional reinforcing layer, which is embedded in the plastics material of the catch arm.
Figure 5B:
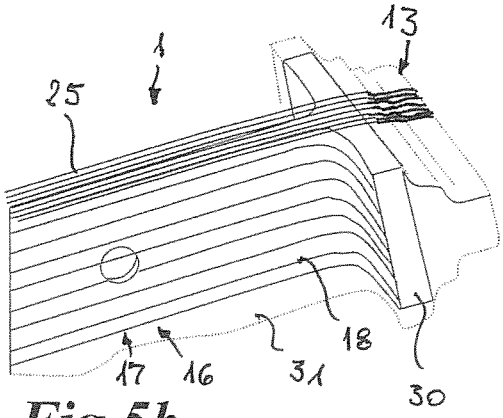
FIG. 5*b* shows a perspective view of a detail of an eighth embodiment of a catch arm according to the invention, in which a fanning out of the layers of fibres from a band, similar to FIG. 4, is provided as an insert, which is overmoulded by further plastics material, a running-around additional reinforcement with fibre material being provided and embedded in the overmoulding plastics material.
Figure 6:
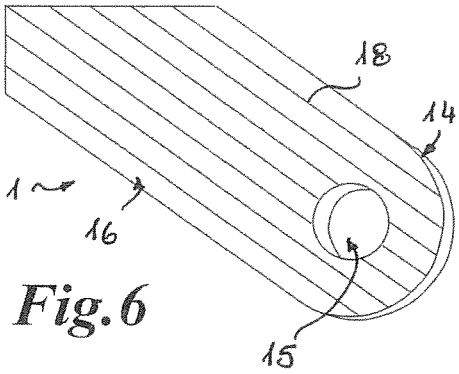
FIG. 6 shows a perspective view of a detail of one end of a catch arm body according to the invention of a door locker unit according to the invention with an opening at the end, fibres of the fibre-reinforced plastics material being interrupted by the opening.

As shown in FIGS. 5*a* and 5*b*, a running-around additional reinforcement by fibres 25 may be provided both along the catch arm body 16 and the catch arm head 13. In FIGS. 5*a* and 5*b*, a running-around reinforcing layer with such fibres 25 is indicated. The configurational variant of the catch arm 1 shown in FIG. 5*b* has the insert 30 of fibre-reinforced plastics material, which is formed in a way similar to the configurational variant that is shown in FIG. 4, with a surrounding of plastics material 31 on all sides, which has here by way of example a stepped shaping to form the catch arm head 13. The catch arm head 13 that is shown in FIG. 5*a* consists of a correspondingly formed plastics material 31, which is provided with the fibres 25 on the outside and/or inside.

Figure 7:
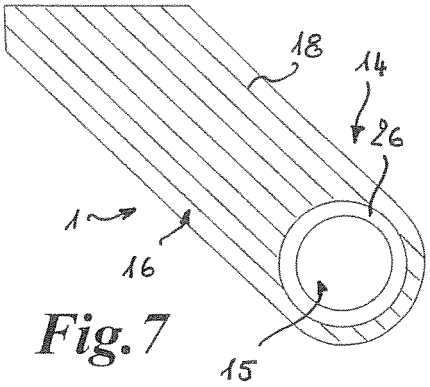
FIG. 7 shows a perspective view of a detail of one end of a catch arm body according to the invention of a door locker unit according to the invention, a difference from the embodiment that is shown in FIG. 6 being that the opening is reinforced by a metal sleeve or wound fibre sleeve additionally inserted there.

In FIGS. 6 to 10*c* are various configurational variants of the catch arm 1 in the region of its second end 14, which is provided with the opening or through-opening 15 for engagement of the hinge pin 104, and consequently the articulated or pivotable mounting of the catch arm 1 on the bearing 105. In the case of the configurational variant of the second end 14 of the catch arm 1 shown in FIG. 6, the through-opening 15 has been drilled into the second end 14 of the catch arm 1 or catch arm body 16. It may also be formed by piercing with a warm mandrel, so that no interruptions of the fibres occur in the region of the opening 15, as takes place when drilling the opening 15 in FIG. 6. It is evident there that the fibres 18 are broken through in the region of the opening 15. By contrast, the piercing with a warm mandrel leads to a design similar to the design shown in FIG. 8*a* without interruption of the fibres. In order to reinforce the opening 15, and consequently prevent propagation of cracks, in the case of the form of the opening that is shown in FIG. 7 a bush 26 has been inserted there. The bush 26 may consist of metal and/or fibres. By the provision of such a bush 26, propagation and creep of a crack already present there can be prevented.

Figure 8A:
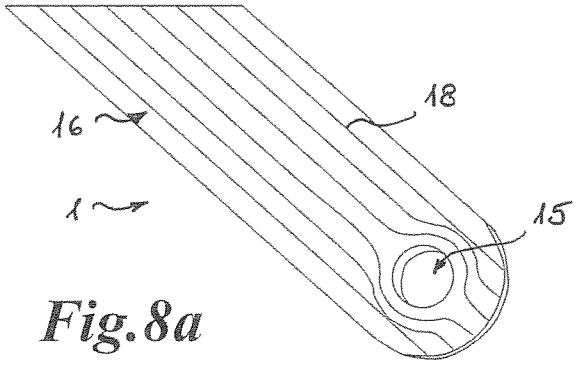
FIG. 8*a* shows a perspective view of a detail of a catch arm body according to the invention of a door locker unit according to the invention, an opening at the end of the catch arm body being provided by fibres being laid around the opening appropriately for the load paths up to the end of the catch arm body without interruption of the fibres.
Figure 8B:
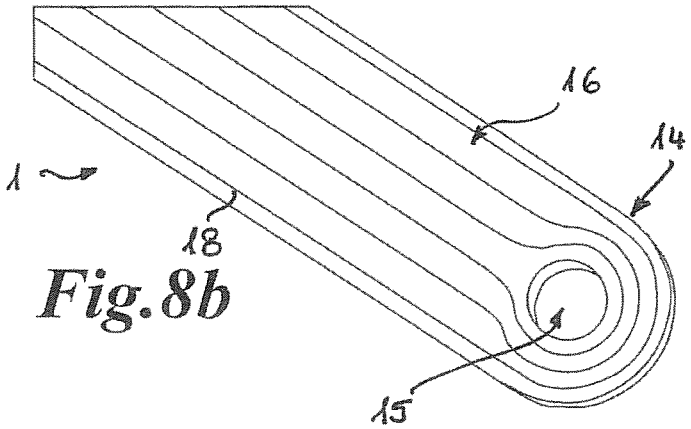
FIG. 8*b* shows a perspective view of a detail of a further embodiment of a catch arm body according to the invention of a door locker unit according to the invention, a difference from the embodiment that is shown in FIG. 8*a* being that the fibres are laid around the opening at the end of the catch arm body without interruption and returned in the direction of the catch arm head (not shown)

If such a bush 26 is not to be introduced into the opening 15, a reinforcement of the opening 15 may also be performed by depositing the fibres appropriately for the load paths by correspondingly encircling the opening 15, as is shown in FIGS. 8*a* and 8*b*. In the case of the configurational variant that is shown in FIG. 8*a*, the fibres 18 run around the opening 15 and end at the outer end of the second end 14 of the catch arm body 16 once again in longitudinal alignment with respect to the catch arm body 16, whereas the fibres 18 in the case of the configurational variant that is shown in FIG. 8*b* encircle the opening 15 and are returned in the direction of the catch arm head 13.

Figure 9:
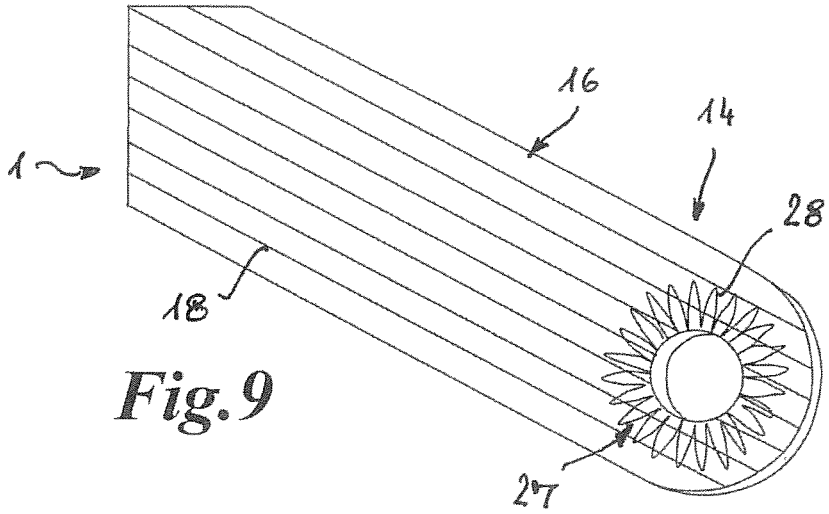
FIG. 9 shows a perspective view of a detail of a further embodiment of a catch arm body according to the invention in the region of its opening at the end, which is stitched around for reinforcement.

A further possibility for reinforcing the opening 15 is shown in FIG. 9. Here, the opening is stitched around with fibres 28, whereby a running-around reinforcement of the opening 15 is obtained. Such a stitching surround 27 of the opening 15 may be given any shaping of various kinds, for example as a star-shaped arrangement of the fibres as shown in FIG. 9.

FIG. 10*a* shows a reinforcing layer with fibres 29 in the direction of the height of the catch arm body 16 around the latter or its end 14. Such a reinforcing layer with fibres 29 may also extend up to the catch arm head 13 or around it, in a way similar to that indicated in FIGS. 5*a* and 5*b*. The arrangement of the fibres 29 may take place on the upper side 10 and/or underside 11 of the catch arm 1, and similarly be offset for example by an angle of 90° thereto at the sides of the catch arm 1.

In the case of the configurational variant shown in FIG. 10*b*, a multi-directional fibre arrangement is provided on the upper side 10 of the catch arm 1 in the region of the second end 14 of the latter around the opening 15, fibres 18 being arranged in the longitudinal direction and fibres 19 being arranged transversely thereto. Such a multi-directional fibre arrangement for thickening the bearing location for the hinge pin 104 and the bearing 105 for the pivotable mounting of the catch arm 1 is consequently created by a multi-axially reinforced fibre-composite material. In FIG. 10*c*, a combination of the configurational variants that are shown in FIGS. 10*a* and 10*b* is shown, it also being possible for still further variants of layers of fibres and fibres that are described above in relation to FIGS. 6 to 9 and 1*a* to 8*b* to be provided there for reinforcement, in particular of the opening 15.

Shown in FIGS. 12 to 15 is a further configurational variant of the catch arm 1, in which a reinforcement of the entire catch arm 1 in its longitudinal direction by means of a running-around, closed, extended reinforcing ring 32 is shown. The reinforcing ring 32 may for example consist of organo sheet or be formed as a thermoplastic prepreg, that is to say in particular from continuous fibres that are embedded in a plastics matrix. The running-around closed reinforcing ring 32 is reversed at both ends of the catch arm 1, a reversal being provided at the first end 12 within the catch arm head 13 around a pin-shaped element 33, for example a metal pin or a plastic pen or the like, whereas the reinforcing ring 32 is reversed at the second end 14 around the opening 15, which is surrounded by a bush 34. The bush 34 may be formed for example as a metal bush, plastic bush, bush of fibre-reinforced plastics material, etc. It is likewise possible even without the provision of such an additional bush 34 to reverse the reinforcing ring 32 around the opening 15 and correspondingly embed it there in plastics material. The plastics material 31 is applied on all sides around the reinforcing ring 32 by overmoulding, so as to obtain the shaping shown in FIGS. 12 to 14, which can be respectively formed application-specifically for the respective catch arm 1. Reinforcing fibres, for example short fibres, may be additionally introduced into the plastics material 31 in order to be able to additionally reinforce it, in particular in a specifically selective manner and also only partially. It is likewise possible to arrange the plastics material 31 around the reinforcing ring 32 by overmoulding without further fibre reinforcement.

Figure 14:
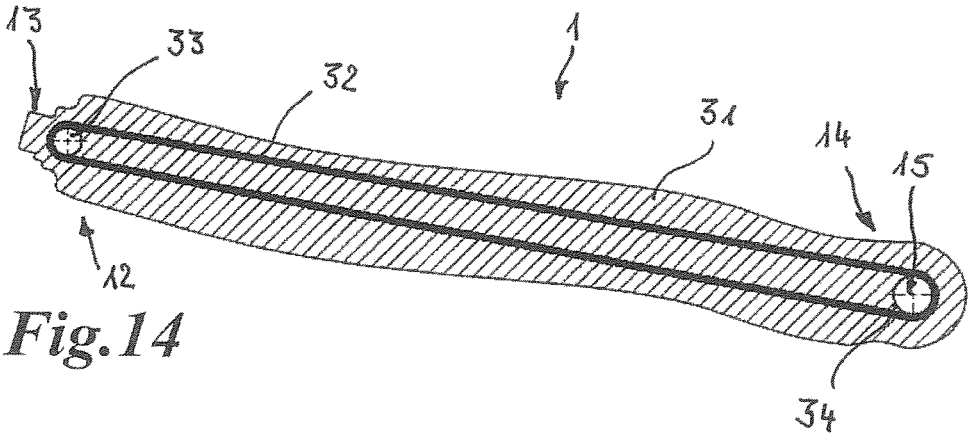
FIG. 14 shows a longitudinal sectional view of the catch arm according to FIG. 12.

As revealed in particular by FIG. 14, the reinforcing ring 32 produced from continuous fibres or at least one band of fibres lies approximately perpendicularly in relation to the alignment of the inserts 30, as they are shown for example in FIGS. 1*a*, 5*b* and 11.

A band of fibres, such as the band of fibres 23 or the reinforcing ring 32, may consequently be arranged inside and/or outside on or along the catch arm 1. In particular when providing the at least one reinforcing ring 32 inside the catch arm 1, further inserts of reinforcing material, in particular fibre-reinforced plastics material, such as organo sheet, are possibly not required and can therefore be omitted.

Short fibres, but with particular preference continuous fibres or long fibres, may be used as fibres for forming the inserts or the fibre-reinforced plastics material, in particular in the region of the fibre reinforcements extending in the longitudinal direction of the catch arm. Long fibres are not continuous and are aligned with less definition than is possible with continuous fibres, it being possible for the fibre alignment to be influenced by corresponding setting of the parameters in the injection-moulding process for overmoulding the fibres with plastics material or embedding them in a plastics matrix. The fibres may, independently of their respective design and orientation, be arranged merely in one layer but also as multiple layers in the catch arm. The fibres are embedded in a suitable plastics material, which is in particular a thermoplastic material but may also be a high-performance plastic and similarly a thermoset, as the matrix material, and the plastics material is brought into the corresponding shaping. In particular, an additional overmoulding with a further plastics material in which no fibres are embedded may be provided in order to form the desired shaping of the catch arm 1. When providing glass fibre mats, they may be pressed together with plastics material in order to obtain the desired shaping. The catch arm may however likewise be formed as a thermoplastic prepreg that has been re-formed into the finished state, in particular by a correspondingly re-formed organo sheet. Furthermore, such a prepreg may be formed as an insert and be overmoulded with plastics material. In the prepreg, the layers of fibres consist for example of spread-out rovings or sheet-like formations, such as woven, nonwoven or braided fabrics. Consequently, a wide variety of configurational variants are possible for forming, and in particular locally reinforcing, the catch arm by fibre-reinforced plastics material.

Apart from the configurational variants of catch arms for a door locker unit that are described above and shown in the figures, numerous others can also be formed, in particular also any desired combinations of the aforementioned features in which at least one elongated catch arm body with at least one catch arm head, arranged at its first end, as an end stop element and at least one opening, arranged at its second end, for articulated pivoting with respect to a bearing, are provided, the catch arm consisting at least partially of at least one fibre-reinforced plastics material.

LIST OF DESIGNATIONS

1 Catch arm
10 Upper side
11 Underside
12 First end
13 Catch arm head
14 Second end
15 Opening/through-opening
16 Catch arm body
17 Latching groove
18 Fibre
19 Fibre
20 Fibre
21 Covering layer
22 Metal element
23 Band of fibres
24 Wrapping loop
25 Fibre
26 Bush
27 Stitching surround
28 Fibre
29 Fibre
30 Insert
31 Plastics material
32 Reinforcing ring
33 Pin-shaped element
34 Bush
100 Door locker unit
101 Housing
102 Latching link
103 Compression spring
104 Hinge pin
105 Bearing
106 Latching cam
107 Damping body
$\alpha$ Angle between 18 and 19

What is claimed is:

1. A catch arm for a door locker unit, of a vehicle door, comprising:

at least one elongated body with a) at least one catch arm head, arranged at a first end of the catch arm, as an end stop element and b) at least one opening, arranged at a second end of the catch arm, for articulated pivoting with respect to a bearing on which the catch arm is mounted, wherein the catch arm is formed at least partially from at least one fibre-reinforced plastics material, wherein continuous fibres are provided as fibres of the fibre-reinforced plastics material and at least one thermoplastic material is provided as a matrix material of the at least one fibre-reinforced plastics material and the fibres are arranged as an insert in at least one overmoulding material of the catch arm as at least one thermoplastic prepreg, and wherein layers of fibres in the prepreg comprise a two or three-dimensional textile reinforcing composite within the thermoplastic matrix material.

2. The catch arm according to claim 1, wherein, from the catch arm first end to the catch arm second end, fibre deposition within the insert is provided appropriate for multiple load paths.

3. The catch arm according to claim 1, wherein the fibres of the fibre-reinforced plastics material are oriented in a direction of a principal loading of the catch arm.

4. The catch arm according to claim 1, wherein at least one organo sheet, being a fibre-composite material or fibres arranged as a textile, is wrapped around a metal element.

5. The catch arm according to claim 1, wherein fibre mats are pressed together with plastic to produce the fibre-reinforced plastics material.

6. The catch arm according to claim 1, wherein two or three-dimensional textile reinforcing structures are layers of fibres in the prepreg, which layers comprise spread-out rovings or sheets.

7. The catch arm according to claim 6, wherein the two or three-dimensional textile reinforcing structures are layers of woven or knitted fabrics or nonwovens as multi-dimensional textile structures.

8. The catch arm according to claim 1, wherein in a region of the at least one catch arm head, a) multiple layers of fibres are provided with fibre directions of the layers arranged differently or b) at least a different fibre orientation than in a different region of the elongated body of the catch arm is provided.

9. The catch arm according to claim 1, wherein the at least one catch arm head is formed from at least one fibre-composite insert by twisting the at least one fibre-composite insert by a twisting angle.

10. The catch arm according to claim 9, wherein the twisting angle is 90°.

11. The catch arm according to claim 1, wherein the at least one catch arm head is formed from the insert by a) fanning out the insert or by b) fanning out and connecting the insert to further layers of material.

12. The catch arm according to claim 1, wherein the at least one catch arm head is formed by a) at least one metal element, or b) comprises the at least one metal element as at least one insert in the at least one catch arm.

13. The catch arm according to claim 12, wherein the at least one metal element is formed as a strip, T-shape or pin-shape.

14. The catch arm according to claim 12, wherein the at least one catch arm comprises a metal element and at least one band of fibres connected to the metal element.

15. The catch arm according to claim 1, wherein for reinforcement, the at least one opening at the second end of the at least one catch arm is provided with a) at least one sleeve or bush of at least one stable material or b) the opening is stitched around or c) fibres are laid around the opening or d) the opening is produced by piercing using a warm mandrel to avoid interruptions of the fibres in a region of the opening.

16. The catch arm according to claim 15, wherein the sleeve is a metal sleeve, wherein the bush is wound from fibres, or wherein the fibres laid around the opening are wrapped around the opening.

17. The catch arm according to claim 1, wherein at least one reinforcing layer is arranged along a longitudinal extent of the at least one catch arm and is formed of at least one closed band.

18. A door locker unit, comprising:

at least one catch arm, at least one latching element, which is supported on the catch arm, at least one housing, the latching element being movably mounted in or on the housing, and the at least one catch arm extending through at least part of the housing and being mounted in an articulated manner, wherein the at least one catch arm is the catch arm according to claim 1.

19. A vehicle door with at least one door locker unit according to claim 18.

20. A vehicle with a vehicle body and at least two vehicle side doors, wherein the vehicle side doors are connectable or connected to the vehicle body in each case by at least one door locker unit according to claim 17 with the at least one catch arm.

21. The door locker unit according to claim 18, wherein the latching element is a latching link or a pressure element.

* * * * *